US006123599A

United States Patent [19]

Chiang

[11] Patent Number: 6,123,599

[45] Date of Patent: Sep. 26, 2000

[54] MULTI-AXIS SOUND TOYS

[76] Inventor: John H. Chiang, 25 Oak Ridge Dr., Voorhees, N.J. 08043

[21] Appl. No.: 09/111,905

[22] Filed: Jul. 8, 1998

[51] Int. Cl.[7] ..... A63H 5/00

[52] U.S. Cl. ..... 446/397; 446/81; 446/196; 446/404; 446/409

[58] Field of Search ..... 446/81, 196, 213, 446/270, 397, 404, 409; 473/571, FOR 162

[56] References Cited

U.S. PATENT DOCUMENTS

| | | | |
|---|---|---|---|
| 1,193,992 | 8/1916 | Cigol | 473/571 |
| 2,443,395 | 6/1948 | Lutins | 473/571 |
| 2,687,888 | 8/1954 | Frampton | 446/397 X |
| 3,106,397 | 10/1963 | Lacey | 446/409 X |
| 3,900,987 | 8/1975 | Holt | 473/571 |
| 4,443,201 | 4/1984 | Diefenbach | 446/213 X |
| 5,590,875 | 1/1997 | Young | 473/571 X |

FOREIGN PATENT DOCUMENTS

| | | | |
|---|---|---|---|
| 589142 | 6/1947 | United Kingdom | 446/270 |

*Primary Examiner*—John A. Ricci
*Attorney, Agent, or Firm*—Caseari, Rivise, Bernstein, Cohen & Pokotilow, Ltd.

[57] ABSTRACT

Toys including a body section and at least three sound tubes retained in the body section. Most preferably the sound tubes each have a longitudinal axis extending in a different direction from at least two other sound tubes. The toys can be hard or soft and can include body sections having a variety of different geometric shapes. The toys make a fun sound when moved in a number of different directions.

11 Claims, 5 Drawing Sheets

FIG. 1
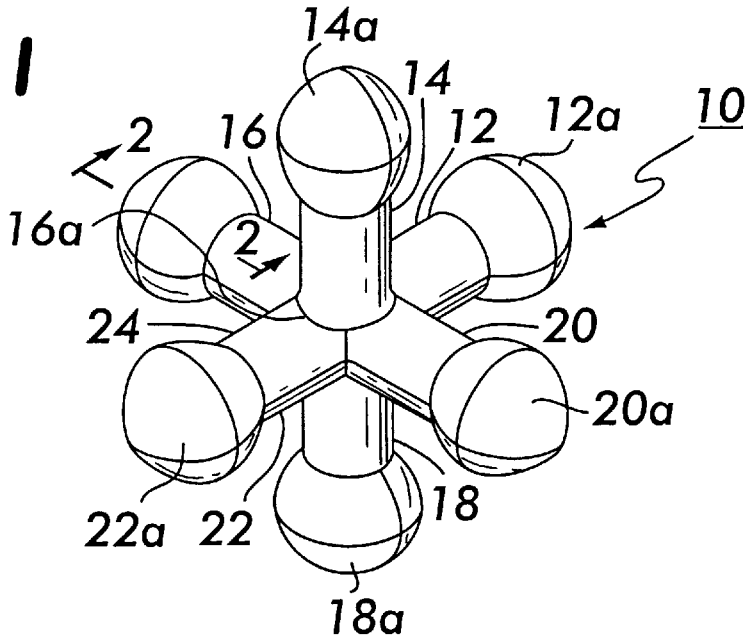
FIG. 3
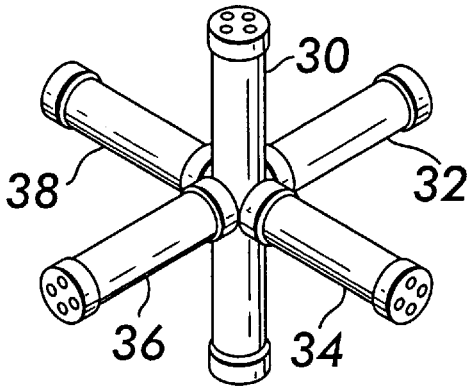
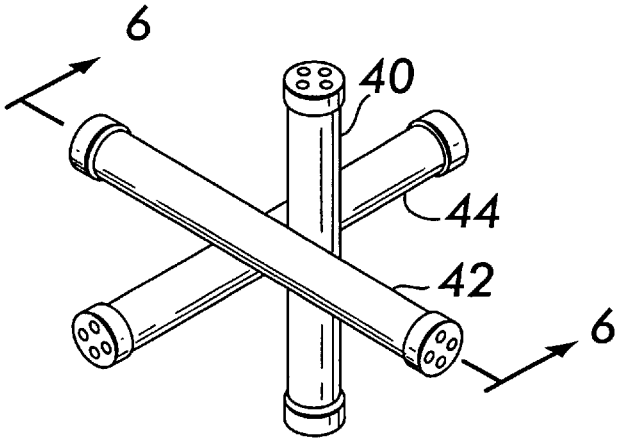
FIG. 4

FIG. 6
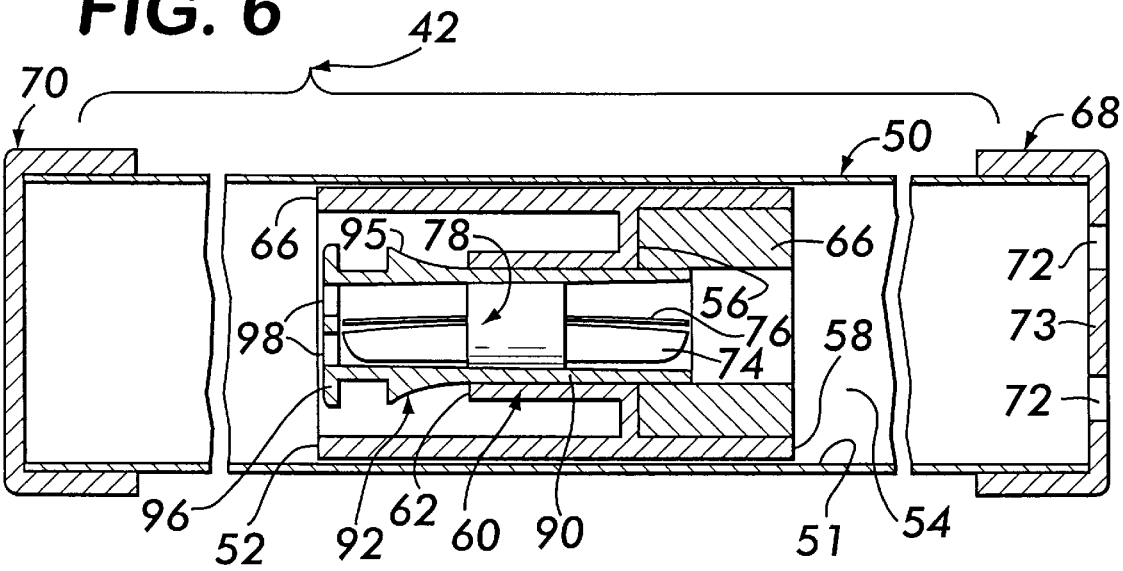
FIG. 7
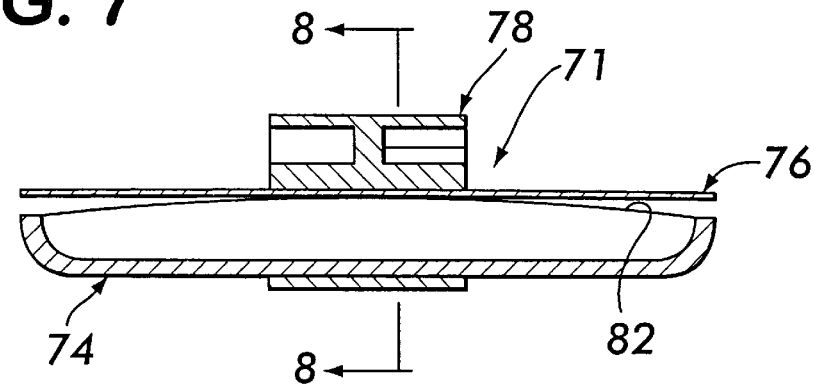
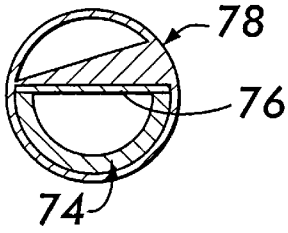
FIG. 8

MULTI-AXIS SOUND TOYS

BACKGROUND ART

Non-battery operated sound producing toys employing a single, mechanical sound tube are known in the art. The sound tube employed in these prior art toys includes an elongate, cylindrical outer sleeve having an internal cylindrical passage and a cylindrical slidable member therein. The slidable member includes a sound generating system that generates sound when the member slides linearly within the internal cylindrical passage of the sound tube from one end to the other. In use, sound is only generated when the sound tube is rotated or pivoted in a manner that causes the slidable member to slide within the outer sleeve.

While the above-described toys do have some entertainment value, their excitement is diminished by the fact that only a very limited range of motion generates the fun sound. Therefore, a need exists for non-battery operated, sound generating toys that will generate a fun sound when moved through a greater range of motions than the above-described prior art toys.

OBJECTS OF THE INVENTION

It is a general object of this invention to provide a non-battery operated, sound generating toy that is exciting to use.

It is a more specific object of this invention to provide a non-battery operated, sound generating toy that is more exciting to use than prior art, non-battery operated, sound generating toys.

It is yet another object of this invention to provide a non-battery operated, sound generating toy that generates sound in an easier manner than prior art, non-battery operated, sound generating toys.

It is yet another object of this invention to provide a non-battery operated, sound generating toy that generates a fun sound when rotated through a greater range of rotational motions than prior art, non-battery operated, sound generating toys.

It is yet another object of this invention to provide non-battery operated, sound generating toys having a number of different shapes or configurations.

SUMMARY OF THE INVENTION

The above and other objects of this invention are achieved in a toy including a body section and at least three, elongate sound tubes retained therein, with each elongate sound tube having an elongate axis oriented in a direction different from the elongate axes of the other two sound tubes. The body section can include a wide variety of different shapes and configurations, as long as it is capable of receiving and retaining at least three, elongate sound tubes therein.

Reference to "sound tube" or "sound tubes" in connection with this invention includes all elongate members having a linear axis and that generate an audible sound when rotated in at least one direction. Sound tubes useable in this invention include conventional sound tubes of the type employed in the earlier-described, prior art, non-battery operated, sound generating toys, as well as the sound tube specifically described in detail later in this application. The most preferred sound tubes generate an audible sound when rotated in a manner to cause the linear axis to have a vertical component of motion.

BRIEF DESCRIPTION OF THE DRAWINGS

The above and other objects of this invention will become readily apparent from the detailed description which follows, when taken in conjunction with the accompanying drawings, wherein:

FIG. 1 is an isometric view of one toy in accordance with this invention;

FIG. 3 is an isometric view showing a preferred arrangement of sound tubes in the toy illustrated in FIG. 1;

FIG. 4 is an isometric view showing an alternative arrangement of sound tubes in the toy illustrated in FIG. 1;

FIG. 6 is a sectional view taken along line 6—6 of FIG. 4;

FIG. 7 is an enlarged sectional view showing the construction of the sound generating reed assembly employed in the sound tube utilized in this invention;

FIG. 8 is a sectional view taken along line 8—8 of FIG. 7;

DESCRIPTION OF THE BEST MODES OF THE INVENTION

Figures 2, 5:
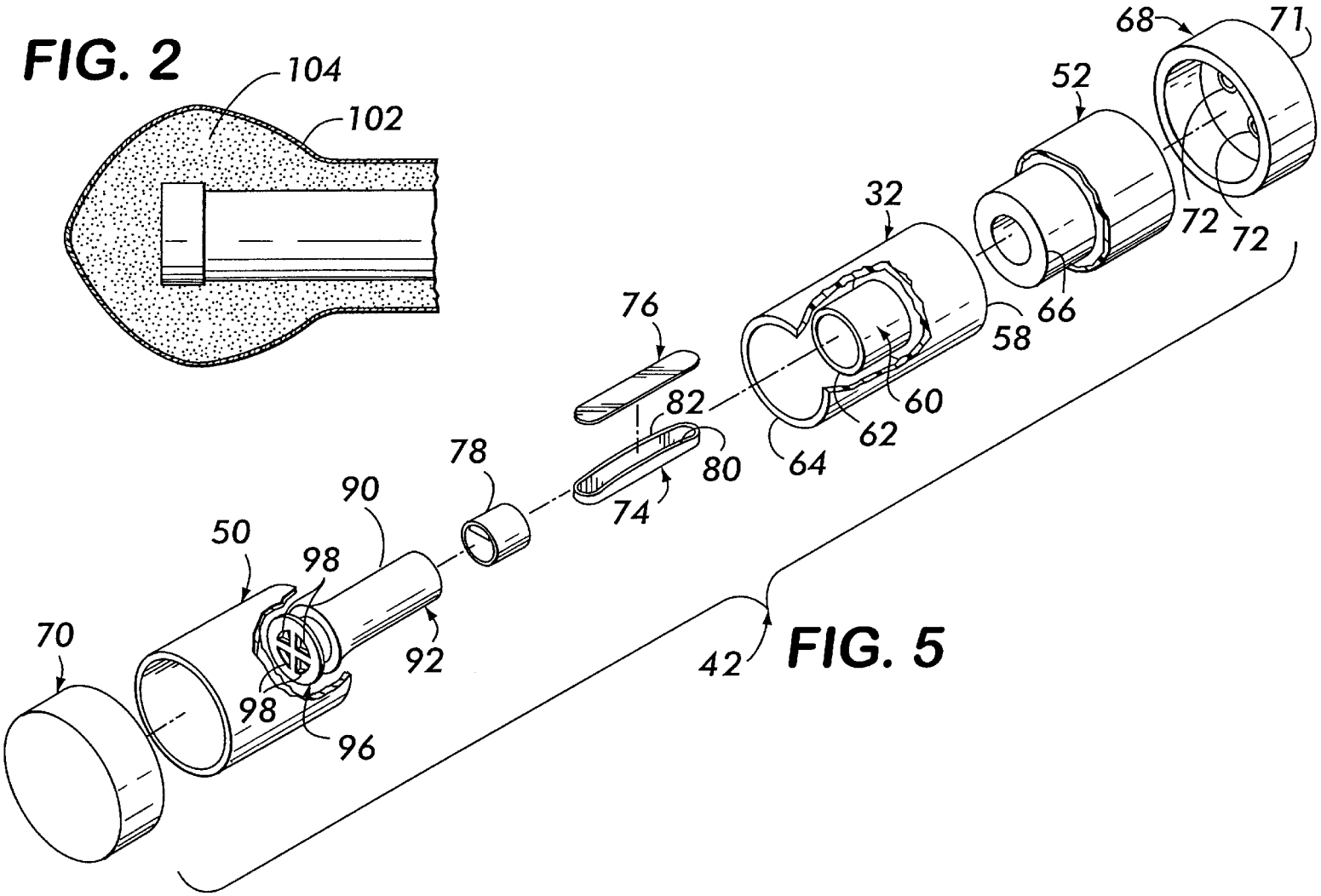
FIG. 2 is a sectional view taken along line 2—2 of FIG. 1.
FIG. 5 is an exploded, fragmentary isometric view of a sound tube employed in the toys of this invention.

Referring to FIG. 1, one embodiment of a sound producing toy in accordance with this invention is shown at 10. This is a soft, jack-like construction including six, substantially equal length arms 12, 14, 16, 18, 20 and 22 extending outwardly from a central hub section 24. Each of the arms is substantially perpendicular to its adjacent four arms, e.g , arm 12 is substantially perpendicular to arms 14, 16, 18 and 20.

Referring to FIG. 3, in the preferred embodiment of the toy 10, five (5) sound tubes 30, 32, 34, 36 and 38 are employed. Except for the fact that sound tube 30 is approximately twice the length of the other four sound tubes, the construction of all of the sound tubes is identical. The construction of the sound tubes 30, 32, 34, 36 and 38 will be described in detail hereinafter. Suffice it to state at this point that each of the sound tubes includes an elongate cylindrical outer sleeve with an internal, slidable sound generating member therein.

Referring to FIGS. 1 and 2, the arrangement of sound tubes is such that they all meet at a junction constituting the central hub section 24 of the toy, i.e., the location where all of the arms 12–22 meet.

Referring to FIG. 4, another arrangement of sound tubes 40, 42 and 44 usable in the toy 10 is illustrated. In this embodiment, all sound tubes are of equal length, and each sound tube extends into a pair of diametrically opposed arms of the toy, e.g., sound tube 40 extends into arms 14 and 18; sound tube 42 extends into arms 16 and 20 and sound tube 44 extends into arms 12 and 22. This arrangement generally is not as preferred as the arrangement shown in FIG. 2, because the region constituting the central hub section 24 of the toy, where the sound tubes cross each other, is quite bulky; thereby resulting in a structure that is somewhat more difficult to handle and that is not as aesthetically pleasing as the structure employing the sound tubes 30–38.

Referring to FIGS. 5 and 6, the construction of sound tube 42 is illustrated, it being understood that all of the sound tubes, although possibly of different lengths, have the same structural arrangement of elements. Specifically, the sound tube 42 includes an elongate, cylindrical outer sleeve 50 and an internal, cylindrical, sound creating member 52 therein. The outer sleeve 50, is approximately eight inches long; having an internal cylindrical passage 54 with an internal diameter of approximately ¾ of an inch.

Still referring to FIGS. 5 and 6, the internal cylindrical, sound creating member 52 has a length of approximately 1⅜th inches and an external diameter of approximately ¾ of an inch so as to frictionally and slidably engage inner wall 51 of the internal cylindrical passage 54. The member 52 includes an internal, annular ledge 56 located approximately ¼ of an inch from one distal edge 58. A hollow cylindrical hub 60 extends axially from the inner edge of the annular ledge 56 to a distal end wall 62 that is spaced inwardly from the opposed distal edge 64 of the sound creating member 52.

Still Referring to FIGS. 5 and 6, a weight 66, which can be in any desired form or shape, such as an annular metal washer or other member, is retained on the internal, annular ledge 46 by any suitable adhesive or bonding medium. This weight 66 assists in generating linear movement of the internal sound creating member 52 within the internal cylindrical passage 54 of the outer sleeve 50.

The opposed ends of the outer sleeve 50 are closed by end caps 68 and 70 that, in the preferred embodiment of the invention, are ultrasonically bonded to the body of the cylindrical sleeve 50. One of the end caps 68 includes a series of passages 72 (e.g., four) in the wall 73 covering the internal cylindrical passage 54 of the outer sleeve 50, to thereby communicate the cylindrical passage with the ambient surroundings to permit air to be moved, or forced, out of the outer cylindrical sleeve 50 as a result of the linear sliding movement of the internal member 52 within the internal cylindrical passage 54.

Referring to FIG. 7, a sound generating reed system 71 includes an elongate, hollowed dish-shaped plastic member 74, a very thin elongate reed 76 overlying the open end of the hollowed dish-shaped plastic member and a plastic ring-shaped holding member 78 that slides over the plastic member 74 and elongate reed 76 to hold these latter two elements together in the central region of the plastic member and reed.

As can be seen best in FIGS. 5 and 7, the dish-shaped plastic member 74 includes elongate, spaced-apart top side edges 80 and 82 that are slightly convex, with the peak area, or high point, being substantially in the center of the side edges. The ring-shaped holding member 78 functions to clamp the thin reed 76 against the peak area of the side edges 80 and 82, to thereby provide, or establish, a slight gap between the reed and the top edges of the plastic member 74 in substantially all regions but the peak area. As air moves past the sound generating reed system 71 it will pass through the gap between the reed 76 and the top edges of the plastic member 74, thereby causing the reed to vibrate and emit an audible, fun sound.

Referring to FIGS. 5 and 6, the sound generating reed system 71 is retained within a hollow stem section 90 of an integrally molded holding tube 92 by a compressive force imposed upon the ring shaped holding member 78 of the sound generating reed system. The distal end of the hollow stem section 90, with the sound generating reed system 71 therein, is inserted into and frictionally retained within the interior of the hollow, cylindrical plug 60. The hollow stem section 90 includes a flared section 94 adjacent the proximal end of said stem section to thereby limit, or control, the distance that the stem section 90 can be frictionally inserted into the cylindrical plug 60. A plastic disk section 96 integrally molded at the distal end of the hollow stem section 90 includes four passages 98 therethrough.

When the sound tube 42 is rotated in a vertical plane the weighted, sound-generating member 52 slides within the internal cylindrical passage 54 causing air to move between the reed 76 and the dish-shaped plastic member 74 of the sound generating reed system 71, to thereby vibrate the reed and emit an audible fun sound.

As noted previously in this application, this invention can employ other sound tubes that include an elongate member having a linear axis and that generate an audible sound when the yare rotated or otherwise moved.

Referring specifically to FIGS. 1 and 2, the toy 10 includes an outer covering 102, which can be formed of any desired material. In a preferred form of the invention the covering is a Tricot polyester fabric. A suitable stuffing material 104, such as a polyester fiber stuffing is employed around the sound tubes to provide a cushioning and shape-establishing function. The specific stuffing material that is employed does not constitute a limitation on the present invention and can include a number of other materials, such as a polyurethane or other foam, either alone or in combination with a fiber stuffing material.

Still referring to FIGS. 1 and 2, each of the arms 12, 14, 16, 18, 20 and 22 includes a bulbous distal end (12*a*, 14*a*, 16*a*, 18*a*, 20*a*, and 22*a*, respectively) extending beyond the end of the internal sound tubes. The bulbous configuration is maintained by employing a suitable stuffing material within the outer fabric covering 102, which can be the same as the stuffing material 104 employed around the sound tubes.

Referring to FIGS. 1 and 3, as noted earlier, the sound tube 30 is the longest tube and extends into diametrically opposed, axially aligned arms 14 and 18; passing through the central hub section 24. The remaining four (4) sound tubes 32, 34, 36 and 38 are approximately ½ the length of the sound tube 30, and each extends into a respective arm 12, 20, 22 and 16. Each of these latter four tubes has one end abutting the outer surface of the sound tube 30, and the other end extending into a respective arm of the toy 10. This construction maintains a desirable, minimum thickness or bulk in the region of the central hub section 24. However, if a greater thickness or bulk is tolerable or desirable in the central hub section 24, it is possible to employ only three sound tubes; each being the same length as the sound tube 30. In this latter construction, each sound tube extends through the central hub section 24 into a corresponding pair of axially aligned arms, with each sound tube being laterally offset slightly from the other two sound tubes so that the sound tubes can pass, or bisect each other in the region of the central hub section 24. This latter arrangement of sound tubes is illustrated in FIG. 4.

It should be noted with the jack-like toy 10 that except for a rotational spinning motion about the Z-axis virtually all other rotational motions of the toy will cause at least one of the internal sound tubes to have a vertical component of movement; resulting in the creation of a fun sound.

Figure 9:
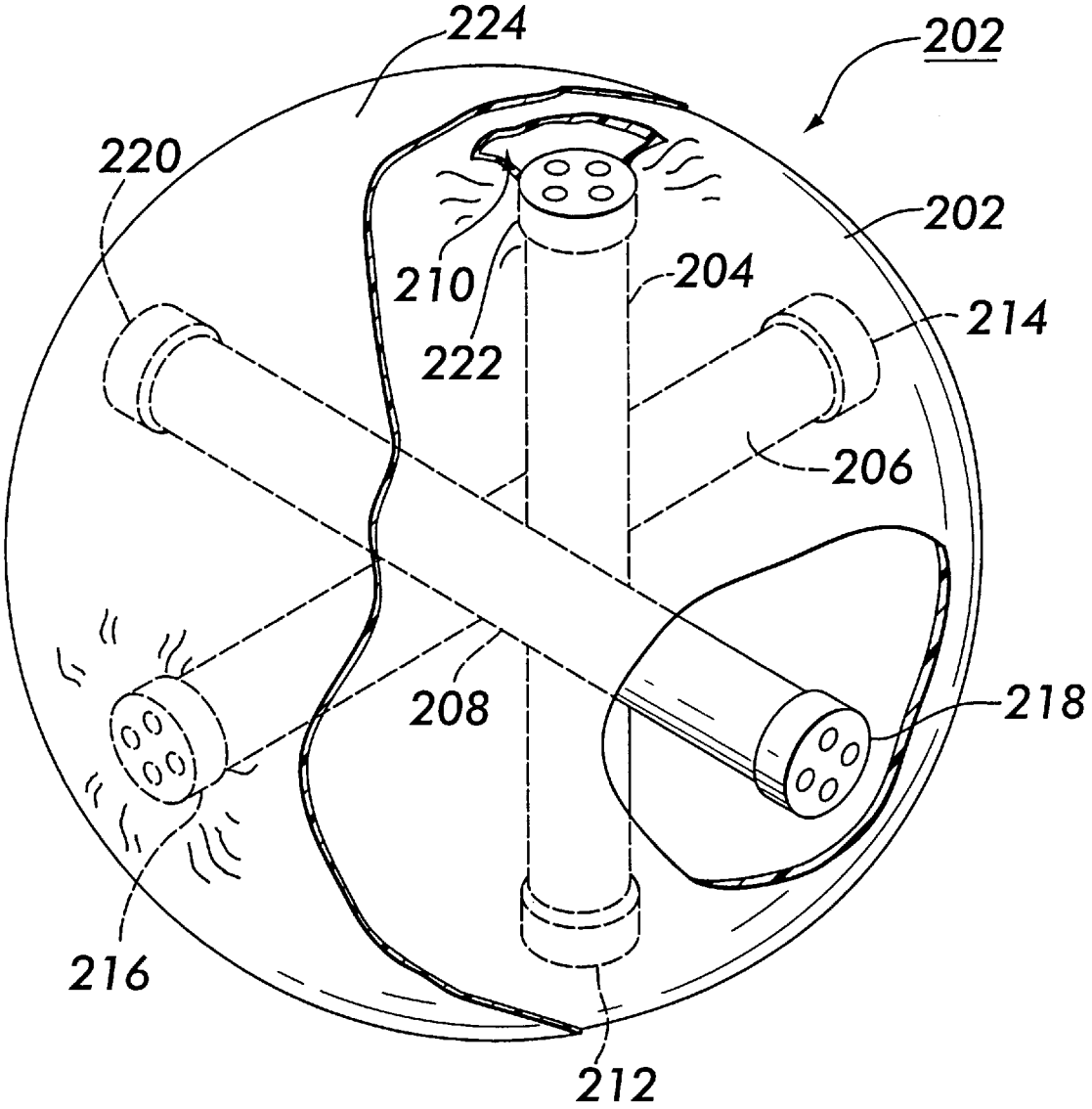
FIG. 9 is an isometric view illustrating a second embodiment of a toy in accordance with this invention.

Referring, to FIG. 9, another embodiment of this invention in the form of a spherical toy in the form of a ball is shown at 200. This ball includes a hollow, rigid, spherical shell 202, preferably made from a suitable plastic material such as polyvinyl chloride (PVC). Three sets of axially aligned openings are provided through the outer periphery of the shell 202 to receive three, substantially equal length sound tubes 204, 206 and 208 therein. Specifically, a first set of axially aligned openings 210 and 212 receives the sound tube 204 therein; a second set of axially aligned openings 214 and 216 receives the sound tube 206 therein and the third set of axially aligned openings 218 and 220 receives the sound tube 208 therein. The three sets of axially aligned openings are positioned such that each of the three sound tubes 204, 206 and 208 retained therein will be substantially in mutually perpendicular positions relative to each other.

Still referring to FIG. 9, each of the openings 210–220 includes a generally inwardly directed annular wall area 222 (only one such area being illustrated) to which the distal ends of each of the sound tubes are bonded by a suitable adhesive, with the three sound tubes 204, 206 and 208 crossing each other in generally the same manner as is illustrated in FIG. 4. The construction of the ball 200 is completed by providing an outer covering 224 about the spherical shell 202. A preferred out covering 224 is a Tricot polyester fabric, although the particular covering material is not considered to be a limitation on the present invention.

Although the spherical ball 200 described above is a rigid construction, as a result of employing the PVC spherical shell 202, the spherical toy 200 also can be made as a "soft" toy. In this latter construction the three sound tubes preferably are secured together in their mutually perpendicular orientation by suitable wiring or by a suitable bonding. With the sound tubes secured to each other, a stuffing or padding material, e.g., a polyester fiber stuffing, a polyurethane foam or another suitable foam, can be packed or shaped into a spherical configuration for receiving the sound tubes therein, and then an outer covering, e.g., a Tricot polyester fabric, is tightly wrapped about the stuffing to form the finished product. If desired the stuffing or packing can be packed so tightly around the sound tubes that the stuffing alone can retain the sound tubes in the desired or required orientation relative to each other. In this case the sound tubes do not need to be wired or bonded together. For example, when the stuffing is in the form of a foam material passages can be provided therein for retaining the sound tubes in their desired or required orientation.

Figure 10:
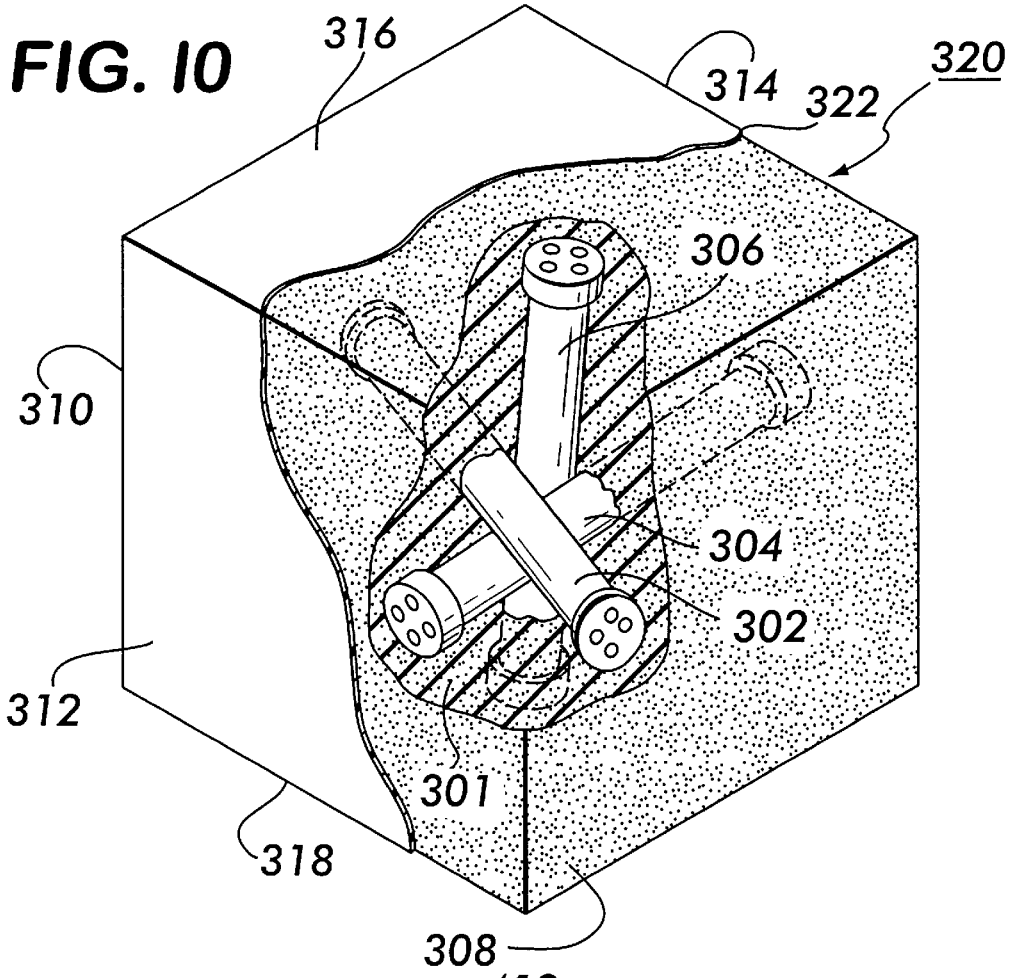
FIG. 10 is an isometric view illustrating a third embodiment of a toy in accordance with this invention.

Referring to FIG. 10, a third embodiment of a toy employing this invention is illustrated at 300. This toy 300 is similar to the previously disclosed embodiments, except that it is in the form of a six-sided polyhedron. In the specifically disclosed embodiment the polyhedron is a cube, although other configurations can be employed.

Still referring to FIG. 10, the cube toy 300 illustrated therein is a "soft toy" with the interior body 301 being a suitable foam material, such as a polyurethane foam. In this construction three sound tubes 302, 304 and 306 are retained within passages of the foam body 301 with their axes extending in three different directions and with each sound tube intersecting the other two sound tubes. That is, each sound tube is transversely offset from the other two sound tubes a distance that is sufficient to permit each sound tube to pass the other two sound tubes. The construction is complete by an outer covering 322, e.g., a Tricot polyester fabric disposed tightly about the interior body 301.

As can be seen in FIG. 10, each sound tube has its elongate axis extending between two diametrically opposed sides of the polyhedron. In particular the sound tube 302 has its elongate axis extending between opposed sides 308, 310; the sound tube 304 has its elongate axis extending between opposed sides 312, 314 and the sound tube 306 has its elongate axis extending between opposed sides 316, 318.

If desired, the polyhedron toy 300 can be made rigid, in the same manner as the spherical toy 200. That is, the toy can include a hollow rigid plastic shell, like the shell 202, but in the configuration of a polyhedron, e.g., a cube, rather than a sphere. In this embodiment, three sets of opposed axially aligned openings are provided for receiving the three sound tubes therein, respectively, in the same manner as the sound tubes in the toy 200 are secured within the axially aligned openings in the spherical shell 202. The construction of the rigid polyhedron toy is completed with any desired outer covering, such as a Tricot polyester fabric.

Figure 11:
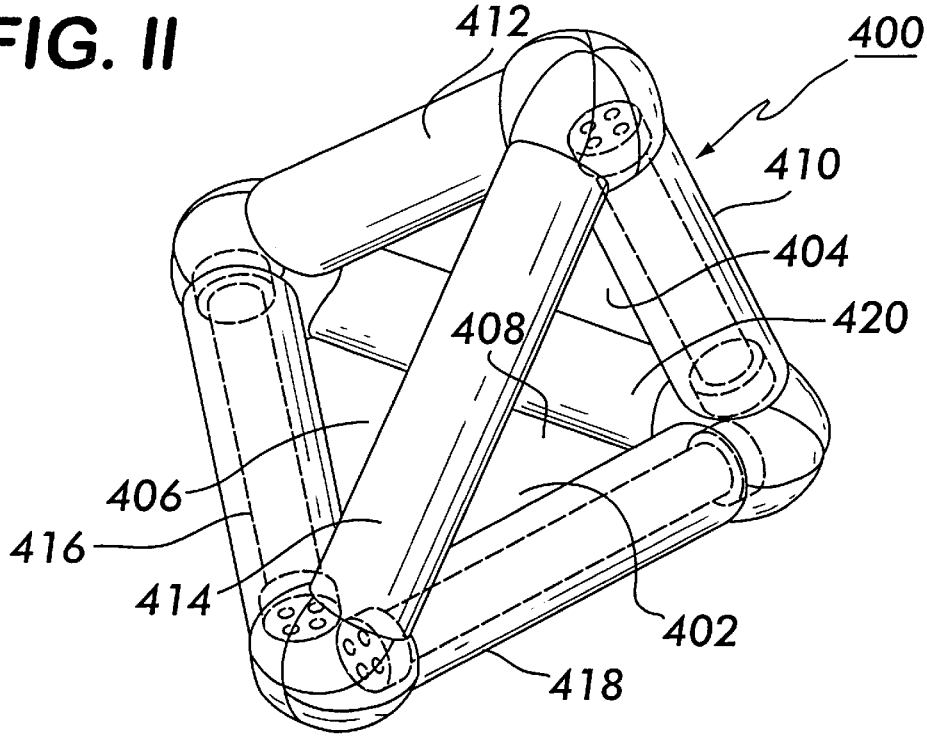
FIG. 11 is an isometric view illustrating a fourth embodiment of a toy in accordance with this invention.

Referring to FIG. 11, another embodiment of a sound toy of this invention is shown at 400. The toy 400 is in the general form of a tetrahedron; having four triangular-shaped open sides 402, 404, 406 and 408 formed, or defined by, six elongate arms 410, 412, 414, 416, 418 and 420. Specifically, open side 402 is defined by elongate arms 416, 418 and 420; open side 404 is formed by elongate arms 410, 412 and 420; open side 406 is formed by elongate arms 412, 414 and 416 and open side 408 is formed by elongate arms 410, 414 and 418. In the illustrated embodiment only the three arms 410, 416 and 418 have sound tubes in them; each tube extending in a different direction from the remaining two tubes. Although sound tubes could be included in one or more of the other arms, the three sound tubes included in the toy 400 will generate a fun sound when the toy 400 is moved in almost any direction.

If desired, the toy 400 can be formed in a manner similar to the jack-type toy 10 illustrated in FIG. 1. That is any suitable padding or stuffing material can be included around the sound tubes, in the arms that do not include sound tubes in them, and in the bulbous junctions of the arms, to thereby provide cushioning function for the sound tubes and a shape-defining function for all of the arms, including the arms employing the sound tubes.

Without further elaboration, the foregoing will so fully illustrate this invention that others may, by applying current or future knowledge, readily adapt the same for use under various conditions of service.

What is claimed is:

1. A toy including a body section and at least five sound tubes having longidutinal axes retained in the body section, at least four of said sound tubes being of the same length and having longitudinal axes that are perpendicular to each other and one of said sound tubes being substantially twice the length of said at least four of said second tubes that have the same length.

2. A toy including a body section and three sound tubes retained in the body section, said three sound tubes crossing each other at a junction to provide six, substantially equal length sound tube segments extending outwardly from said junction.

3. A toy including a body section and five sound tubes retained in the body section, four of said sound tubes being substantially one-half the length of the other of said sound tubes and being perpendicular to said other of said sound tubes.

4. The toy of claim 3, wherein said four of said sound tubes are all located in a plane bisecting said other of said sound tubes.

5. A toy including a body section and at least three sound tubes retained in the body section, said at least three sound tubes meeting each other or crossing each other at a junction, wherein the body section includes plural arms meeting at a junction, said junction of said sound tubes being located at the junction of said plural arms.

6. The toy of claim 5, wherein said body section includes six arms and at least a segment of a sound tube extends into each of said arms.

7. A toy including a body section and at least three sound tubes retained in the body section, said body section being a polyhedron.

8. The toy of claim 7, wherein the polyhedron is a six-sided polyhedron, each side being a substantially planar surface.

9. The toy of claim 8, wherein the polyhedron is a cube.

10. The toy of claim 7, wherein the polyhedron is a tetrahedron having six open sides, each side being provided by plural arms joined to each other.

11. The toy of claim 10, wherein each open side is provided by three arms joined to each other.

* * * * *